US007147401B2

(12) United States Patent
Wickens

(10) Patent No.: US 7,147,401 B2
(45) Date of Patent: Dec. 12, 2006

(54) INSTALLATION AND DRAINAGE SYSTEM FOR SYNTHETIC GRASS

(76) Inventor: Richard B. Wickens, 301 Wyoming Blvd., NE., Albuquerque, NM (US) 87123

( * ) Notice: Subject to any disclaimer, the term of this patent is extended or adjusted under 35 U.S.C. 154(b) by 0 days.

(21) Appl. No.: 11/230,113

(22) Filed: Sep. 19, 2005

(65) Prior Publication Data

US 2006/0067791 A1 Mar. 30, 2006

Related U.S. Application Data

(60) Provisional application No. 60/614,224, filed on Sep. 29, 2004.

(51) Int. Cl.
*E02B 11/00* (2006.01)

(52) U.S. Cl. ..... 405/45; 405/43; 405/51; 472/92

(58) Field of Classification Search ..... 405/36, 405/43, 44, 45, 50, 51; 472/92
See application file for complete search history.

(56) References Cited

U.S. PATENT DOCUMENTS

| | | | | |
|---|---|---|---|---|
| 4,007,307 | A | | 2/1977 | Friedrich |
| 4,044,179 | A | | 8/1977 | Haas, Jr. |
| 4,307,879 | A | | 12/1981 | McMahon |
| 4,337,283 | A | | 6/1982 | Haas, Jr. |
| 4,381,805 | A | | 5/1983 | Troy |
| 4,396,653 | A | | 8/1983 | Tomarin |
| 4,501,420 | A | | 2/1985 | Dury |
| 4,705,706 | A | | 11/1987 | Avery |
| 4,882,208 | A | | 11/1989 | Breitscheidel et al. |
| 4,913,596 | A | * | 4/1990 | Lambert, III ..... 405/43 |
| 4,946,719 | A | | 8/1990 | Dempsey |
| 5,064,308 | A | * | 11/1991 | Almond et al. ..... 405/43 |
| 5,219,243 | A | * | 6/1993 | McCoy ..... 405/43 |
| 5,395,467 | A | | 3/1995 | Rogers, Jr. |
| 5,605,721 | A | | 2/1997 | Geronimo |
| 5,752,784 | A | | 5/1998 | Motz et al. |
| 5,779,393 | A | | 7/1998 | Gunter |
| 5,803,662 | A | | 9/1998 | Gunter |
| 5,850,708 | A | | 12/1998 | Bergevin |
| 5,958,527 | A | | 9/1999 | Prevost |
| 5,976,645 | A | | 11/1999 | Daluise |
| 6,048,282 | A | | 4/2000 | Prevost et al. |
| 6,132,137 | A | | 10/2000 | Gunter |
| 6,139,443 | A | | 10/2000 | Reynolds |
| 6,221,445 | B1 | | 4/2001 | Jones |
| 6,263,616 | B1 | | 7/2001 | Hummer |
| 5,850,708 | C1 | | 9/2001 | Bergevin |
| 6,295,756 | B1 | | 10/2001 | Bergevin |
| 6,299,959 | B1 | | 10/2001 | Squires et al. |
| 6,338,885 | B1 | | 1/2002 | Prevost |
| 6,491,991 | B1 | | 12/2002 | Seaton |

(Continued)

*Primary Examiner*—Frederick L. Lagman
(74) *Attorney, Agent, or Firm*—Dennis F. Armijo

(57) ABSTRACT

The system contains an infill for drainage by using crusher fine to absorb and dispense water to a piping system that releases the water into a leech field system, using a final pipe to dispense the water out of the artificial turf covered field. The specified crusher fine not only adds to the absorption and the drainage, but it also has the ability to give which enables the turf to have the ability to be safer and drain faster. The drainage system also has perforations in the turf for drainage which is installed with nailers over the prepared filed. In addition, specific mixtures of non-compacting silica sand and a symmetric rubber grind make up the infill system.

19 Claims, 5 Drawing Sheets

U.S. PATENT DOCUMENTS

| | | | | |
|---|---|---|---|---|
| 6,527,889 | B1 | 3/2003 | Paschal | |
| 6,551,689 | B1 | 4/2003 | Prevost | |
| 6,616,542 | B1 | 9/2003 | Reddick | |
| 6,620,482 | B1 * | 9/2003 | Carr et al. | 428/87 |
| 6,663,317 | B1 | 12/2003 | Williams | |
| 6,689,447 | B1 | 2/2004 | Prevost | |
| 6,723,412 | B1 | 4/2004 | Prevost | |
| 6,746,752 | B1 | 6/2004 | Prevost | |
| 6,753,049 | B1 | 6/2004 | De Vries | |
| 6,767,595 | B1 | 7/2004 | Prevost et al. | |
| 6,794,007 | B1 * | 9/2004 | Carr et al. | 428/87 |
| 2002/0028307 | A1 | 3/2002 | Prevost | |
| 2002/0029515 | A1 | 3/2002 | Prevost | |
| 2002/0081399 | A1 | 6/2002 | Prevost et al. | |
| 2003/0039511 | A1 | 2/2003 | Prevost | |
| 2003/0056432 | A1 | 3/2003 | Prevost | |
| 2003/0161996 | A1 | 8/2003 | Prevost | |
| 2003/0175448 | A1 | 9/2003 | Prevost | |
| 2004/0058096 | A1 | 3/2004 | Prevost | |
| 2004/0219308 | A1 | 11/2004 | Prevost et al. | |
| 2005/0008793 | A1 | 1/2005 | Prevost | |
| 2005/0031803 | A1 | 2/2005 | Prevost | |
| 2005/0044656 | A1 | 3/2005 | Prevost | |

* cited by examiner

INSTALLATION AND DRAINAGE SYSTEM FOR SYNTHETIC GRASS

CROSS-REFERENCE TO RELATED APPLICATIONS

This application is based on U.S. Provisional Application Ser. No. 60/614,224 entitled "Artificial Turf and Drainage System" filed on Sep. 29, 2004, the teachings of which are incorporated herein by reference.

BACKGROUND OF THE INVENTION

1. Field of the Invention (Technical Field)

The present invention relates to artificial turf, and more particularly to a new artificial turf system and process for installation. Also included is a novel drainage system for artificial turf installations.

2. Background Art

There are several artificial turf systems in the market today. However, these systems include top crowning for water drainage, which causes injuries. In addition, the current rubber infill systems are not liquid absorbent.

Top crowning systems consist of a mount like surface in the middle of the field to allow the water to drain to the sides. A rubber infill or rubber sand infill is usually disposed on the turf material, and a plastic lining is laid underground at an angle to collect water in a centered pipe in order to remove the water build-up. This is typically used in all synthetic grass installations such as sports fields, residential installations, and putting greens.

The prior art methods do not use a natural water drainage system. Normally, under the sports field, the prior art teaches the use of foam to cushion the grass. The reason for the cushion is to protect users from the asphalt layer or plastic lining crowning underneath the turf to run water to the sides where it is collected by pipes. The prior art systems use an all rubber infill that tends to lift upon water build-up, and clump in one area after water drainage. Optionally, they use a sand and rubber infill mix that causes clumping when wet.

Finally, in the prior art systems the sides of the turf material laid on the fields are nailed down to wood. These wood nailers rot, warp, and are vulnerable to insects over several years and weaken on stake inserts, therefore resulting in not holding the grass tightly.

SUMMARY OF THE INVENTION (DISCLOSURE OF THE INVENTION)

The present invention is a unique method and apparatus for providing drainage for a turf installation and a means for fastening the turf material in place. The preferred installation and drainage system for synthetic turf provides for maximized water drainage, perimeter conformity, secure attachment, and a level surface. This invention prevents the need for crowning of a field for water run off, infill clumping or compacting, use of foam pads or absorbent under padding, underground liners, thus preventing anterior cruciate ligament (ACL) injuries or water accumulation on the turf surface that would cause infill to "float" and be moved by water inundation. The installation system of the invention also provides for perimeter conformity, prevents rotting of edges, and secures the attachment of turf to the edges. Finally, this invention provides for longer lasting, better and more natural impact absorption, and less wear and tear.

A novel feature of the present invention is the drainage system, which includes the infill materials comprising non-compacting sand, which comprises ninety seven percent (97%) or better pure silica which is dust free, symmetrical rubber material, the three-eighth inch minus (−⅜") crusher fine, and the four to six inch (4"–6") perforated on center turf material. Throughout this description the three-eighth inch minus (−⅜") crusher fine means that the aggregate is three-eighth inch (⅜") or less in size. The perforations are the holes that go through the back of the turf to provide for drainage. The preferred perforations are one to four inches (1"–4") from center of the stitching of the turf material. In addition, the novel drainage system can include a piping arrangement to capture and disburse the water drained through the turf arrangement.

The primary object of the present invention is to provide a drainage system for a turf installation that is efficient and avoids the degradation of the installation when moisture is applied.

Another primary advantage of the present invention is the improved drainage system. The speed in drainage helps with greater grip for playing physical activities. The drainage process decreases the possibility of slipping, and increases grip. The infill material used such as pure silica sand does not compact when moisture is applied.

Yet another advantage of the present invention is that the nailers used for installations are long lasting and do not warp or rot through time and are constructed from a flexible material.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

BEST MODES FOR CARRYING OUT THE INVENTION

This present invention is in the area of synthetic grass and a unique installation method, including a new infill system with perforations located on center measurements of the turf material and a unique side edging. The invention also consists of a new drainage system for artificial turf installations.

The present invention solves longstanding problems with the present state of the art and this solution provides for a superior G-max rating, higher impact absorption, safety improvement, does not decrease an athletes speed or performance, and yet decreases ACL Injuries. While attaining a grass like density, it improves drainage and lasts longer than presently available turf products.

Figure 1:
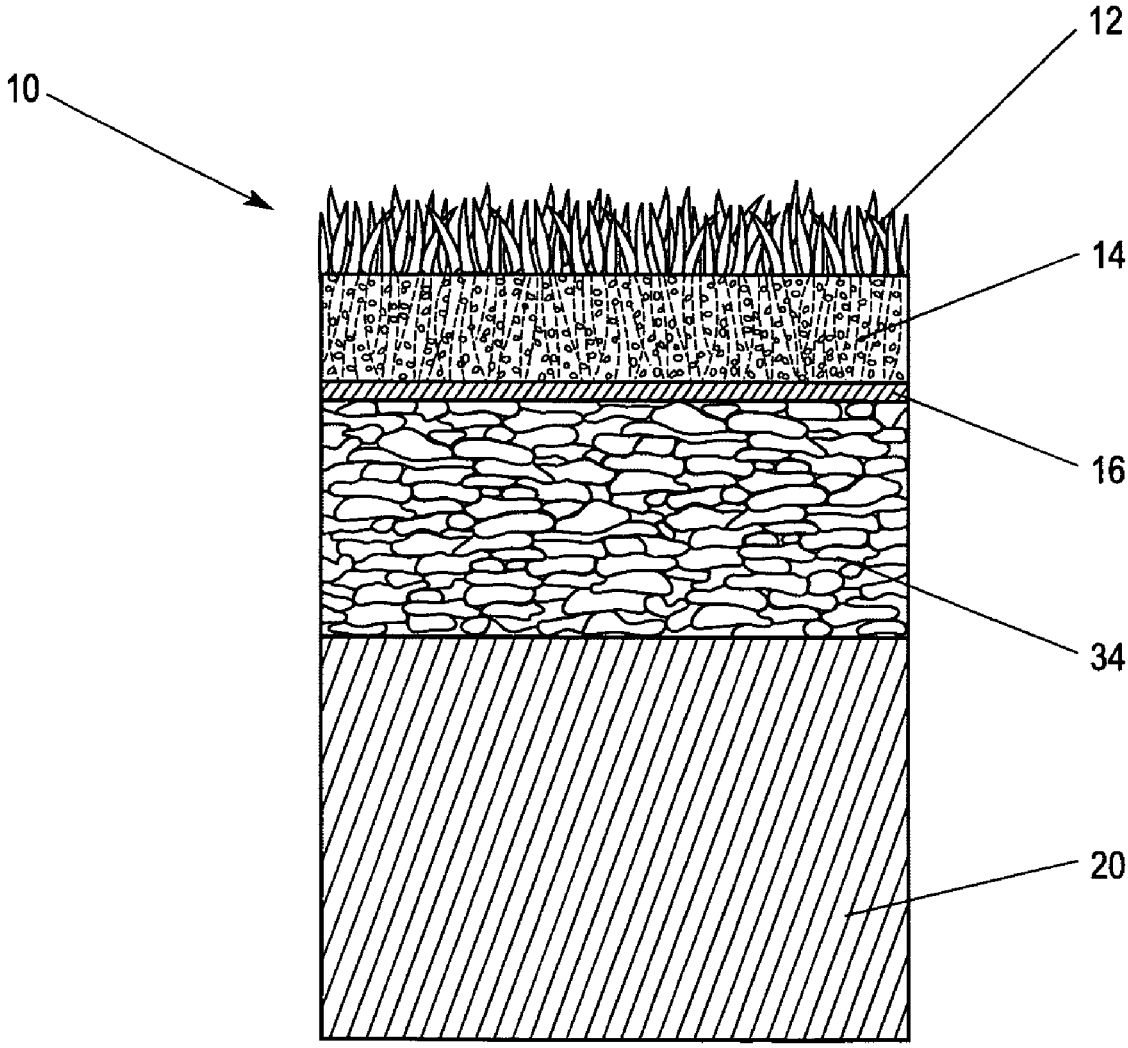
FIG. 1 shows the preferred artificial turf installation.
Figure 2:
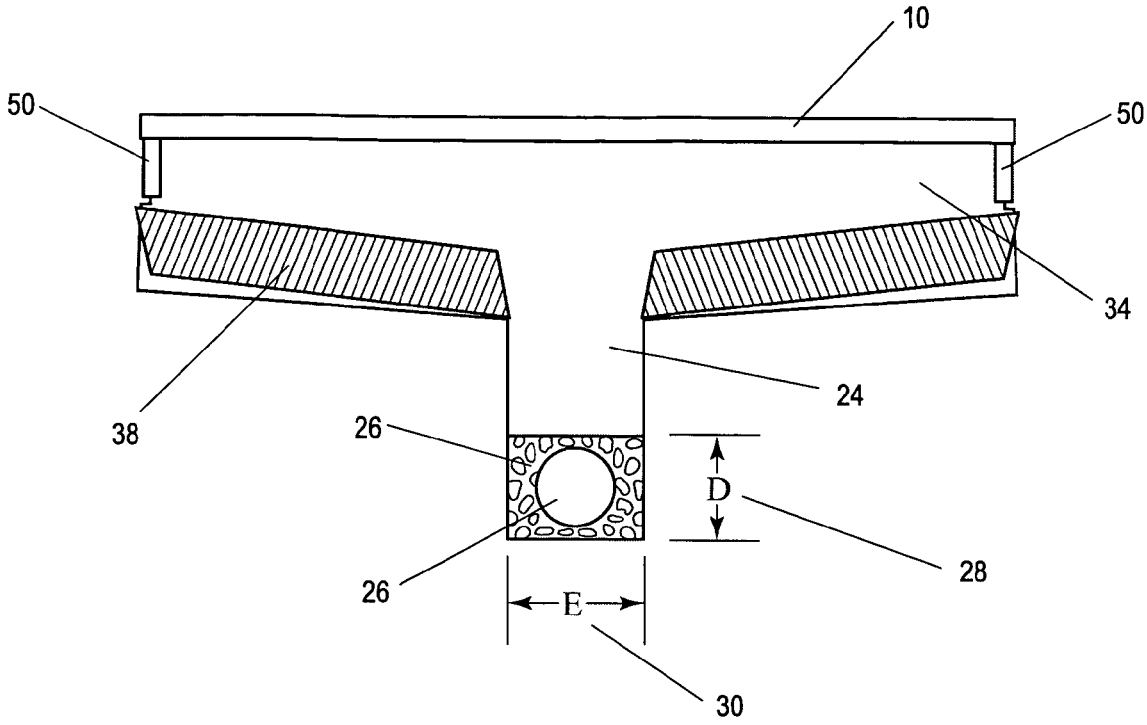
FIG. 2 is a cross section of the preferred drainage system.
Figure 3:
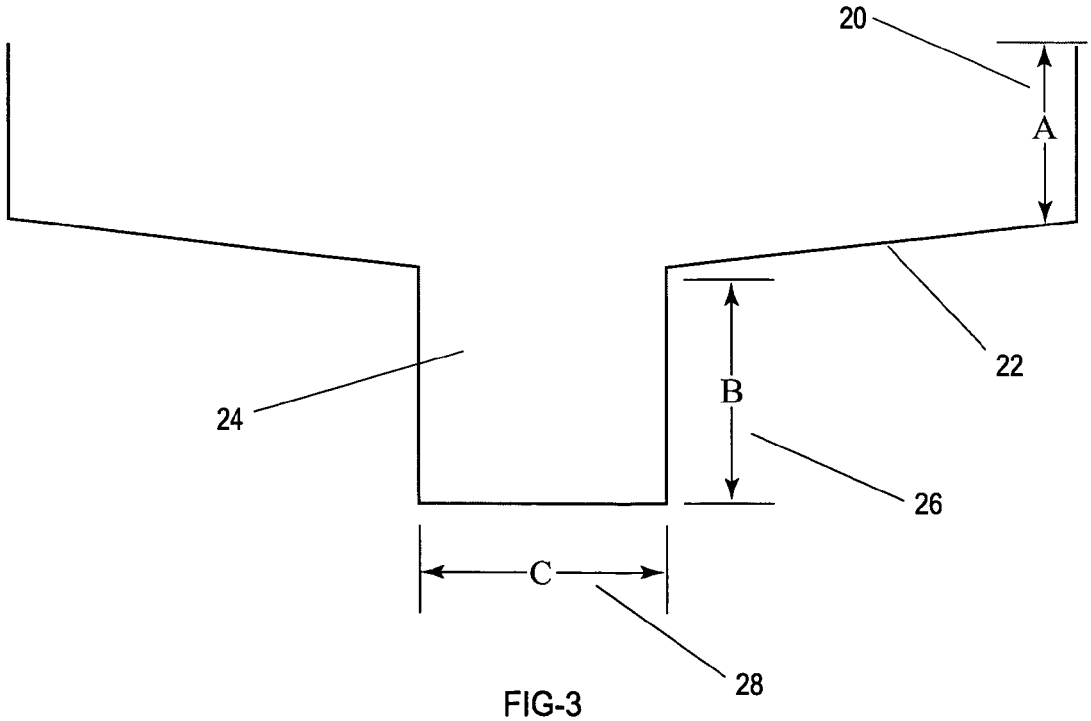
FIG. 3 shows the preferred excavation plan for the drainage system of FIG. 2.

FIG. 1 shows a typical installation. The installation and drainage system for synthetic grass 10 comprises of a fiber layer 12, which is preferable ultraviolet resistant fibers, a predefined infill material 14, which will be discussed in detail, a backing material 16, preferably comprising a multi-ply polyurethane material with equally space apertures for drainage, an aggregate base 18 comprised of a three-eighth inch minus (–⅜") crusher fine or any mixed sized gravel base, all placed as shown on top of natural soil 20. Fiber layer 12 is comprised of non-abrasive ribbons and is affixed to backing material 16 in a pattern similar to natural grass. The preferred turf comprises olefin fiber turf with a three-eighth inch (⅜") perforated hole with perforations from one and one-half inch to four inch (1.5 to 4") on center, and a stitch rate of one eighth (⅛") on center to one quarter inch (¼") on center with a multi-ply backing. The perforations are apertures that go through backing material 16 to provide drainage. The preferred infill material 14 comprises a pre-mixed blend of symmetrical rubber granules and ninety seven percent (97%) or better pure silica dust free sand and is disposed onto fiber layer 12 and backing material 16 between the fibers of the synthetic grass at predefined ratios. Although this description calls for symmetrical rubber granules, the rubber granules can be bullnosed. The purity of the silica and being dust free makes it non-compactable. The ratios of the infill material 14 and length of fibers 12 or ribbon height, are optimized for specific uses. Below are the preferred ratios:

Residential/Landscaping/Park two inch (2") to two and one-half inch (2½") fibers or ribbon height fifty percent (50%) symmetric rubber fifty percent (50%) non-compactable silica one-third inch (⅓") infill of ribbon height Baseball Field—Infield two inch (2") to two and one-half inch (2½") fibers or ribbon height seventy percent (70%) non-compactable silica thirty percent (30%) symmetric rubber one-half inch (½) infill of ribbon height Baseball Field—Outfield two inch (2") to two and one-half inch (2½") fibers or ribbon height fifty percent (50%) non-compactable silica fifty percent (50%) symmetric rubber one-third inch (⅓") infill of ribbon height Football Field/Soccer Field/Rugby Field two inch (2") to two and one-half inch (2½") fibers or ribbon height fifty percent (50%) symmetric rubber fifty percent (50%) non-compactable silica one-third inch (⅓") infill of ribbon height Putting Greens one and one-forth inch (1¼") fibers or ribbon height seventy-five percent (75%) non-compactable silica twenty-five percent (25%) symmetric rubber one and one-eighth (1⅛") infill Fringe one and one-half inch (1½") to two inch (2") fibers or ribbon height fifty percent (50%) non-compactable silica fifty percent (50%) symmetric rubber one-third inch (⅓") infill of ribbon height The present system uses a pure ninety-seven percent (97%) or better silica sand with a symmetric rubber grind infill system. The symmetric rubber helps to provide less wear and tear on the blades of turf 10. On larger areas, the preferred turf installation includes a buried gravity drainage network as shown in FIGS. 2 through 6. This system is used in addition to the installations as previously described. By using this unique system the turf surface does not need to be "crowned" as required by all of the prior art systems. This system provides for adequate drainage for a substantially flat turf surface. FIG. 2 shows a cross-section of a preferred drainage system installed on a football field. FIG. 3 shows a cross-section of the excavation plan for the system of FIG. 2.

In order to install the drainage system the ground needs to be prepared and excavated as shown in FIG. 3. Below is a detailed description for a typical installation. The first step of the process is to survey out the proper dimensions of the field and a benchmark is created for lay out of the field area. Next, utilities are located and marked. Excavation of the first dimension A 20 is made by a front-end loader, bulldozer, or the like. Normally, dimension A 20 is four to six inches (4"–6"); however, in areas with heavy rain, this dimension can be from four to twelve inches (4"–12"). Next, a motor grader, or the like equipped with a laser leveling system with grade sub-base from a zero inch (0") to one inch (1") scale 22 or in heavy rain areas can be from a zero inch (0") to twelve inch (12") scale, from the outside toward the middle of area. This is done on both sides to create a natural flow of water towards the center of the project. Trench 24 is dug down the center of the area an additional distance B 26, normally twelve inches (12") below subgrade or in heavy rain areas up to twenty-four inches (24") and have a width of dimension C 28, which is normally two feet (2') wide or four feet (4') wide in heavy rain areas. A transit or laser leveling system is then used to grade a one to twelve inch (1"–12") slope in trench 24 outward from center of area to outside of area or to tap in point of main sewer (not shown). Additional trenching may be required perpendicular to the center of main trench 24 on a zero to one inch (0"–1") or in heavy rain areas from zero to twelve inch (0"–12") grade from the outside area, the full distance sloping inward to the center of main trench 24.

The next step in the preferred process is to lay main pipe 26 for main trench 24 as shown in FIG. 2. Main pipe 26 is laid in trench 24, as shown. Main pipe 26 is preferably a four inch (4") sewer and drain-perforated pipe. Main pipe 24 is connected with approved PVC primer and glue with slip joints. Perforations on main pipe 26 must be laid face up (not shown). Main pipe 26 should preferably have some type of drainage sock over the perforations to prevent crusher fine 34 from washing away. Large aggregate or gravel 32 is laid into main trench 24 from dimensions D 28 to dimension E 30. Dimension D is normally five to twelve inches (5"–12") and dimension E 30 is normally six to eight inches (6"–8").

Figure 4:
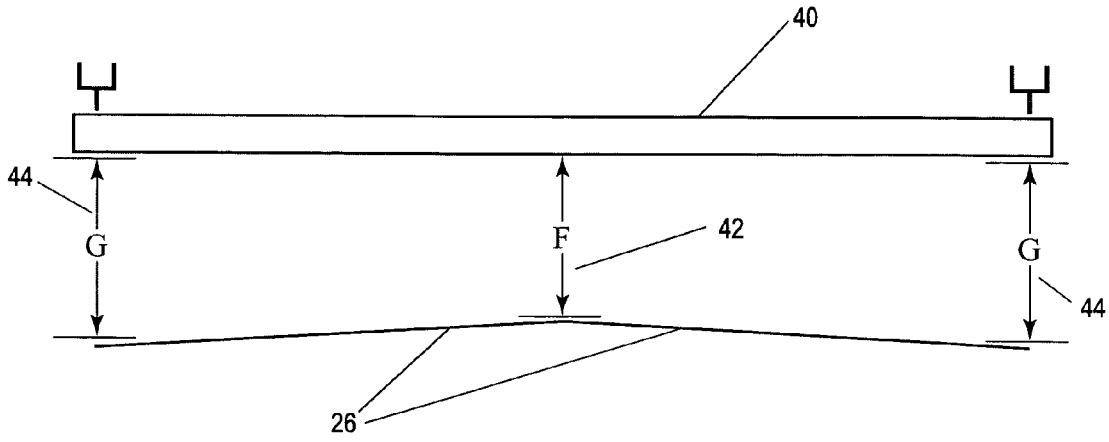
FIG. 4 shows a side view of a typical football field with the preferred drainage system of FIG. 2.
Figure 5:
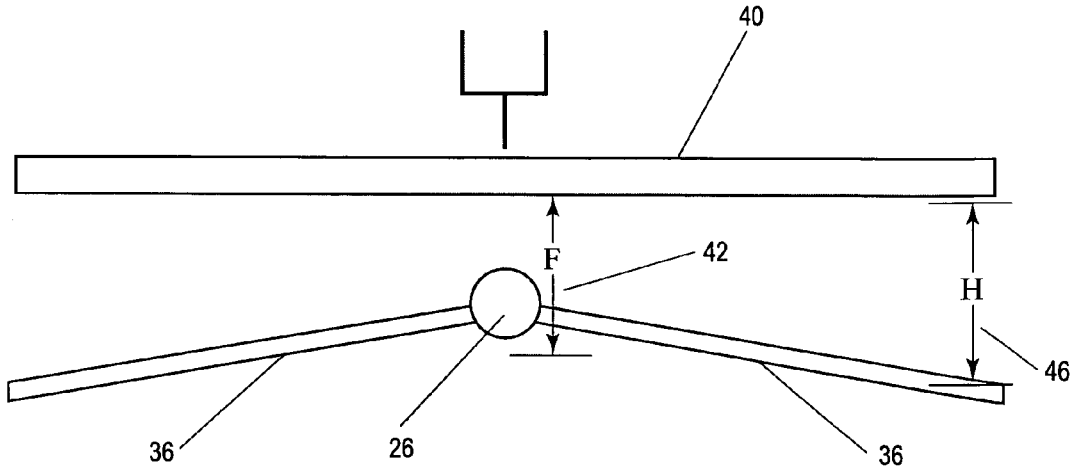
FIG. 5 shows an end zone view of the embodiment of FIG. 4.
Figure 6:
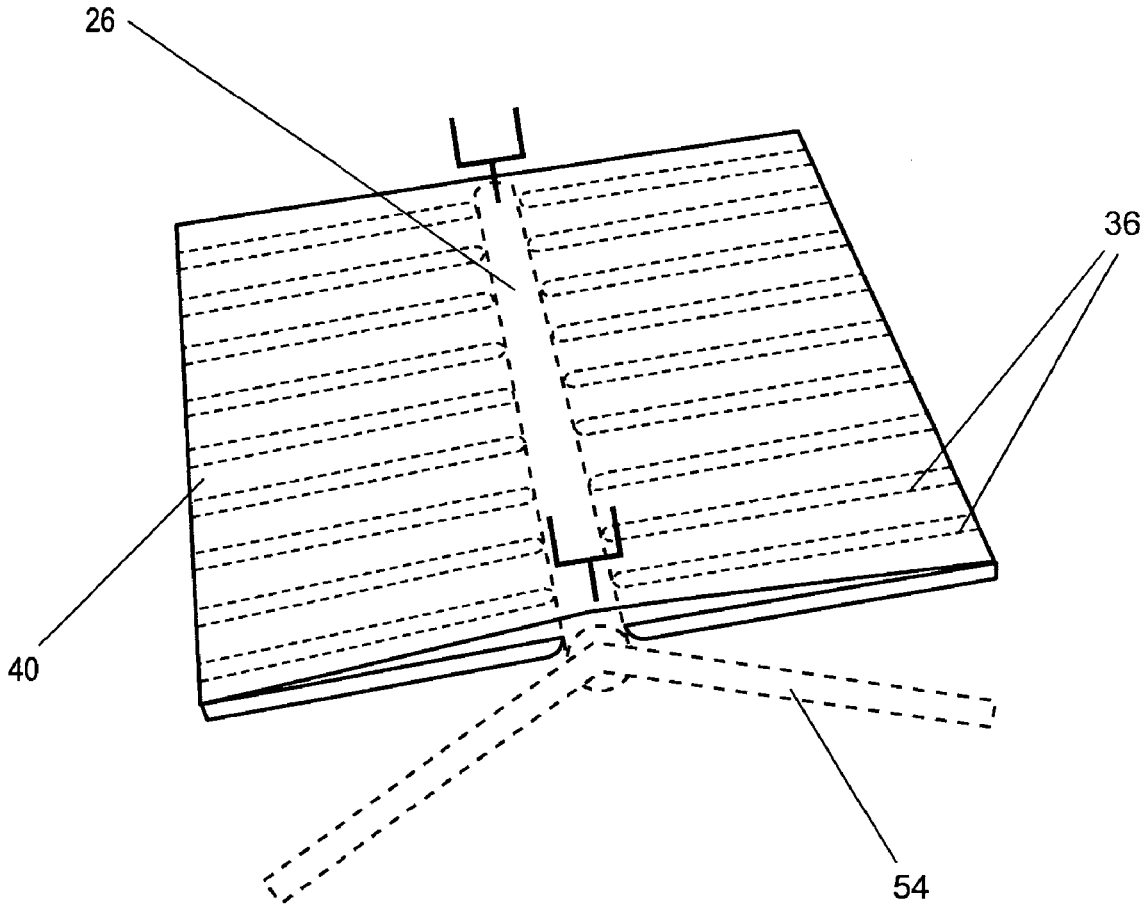
FIG. 6 shows a perspective view of the embodiment of FIG. 4.

The remaining area of main trench 24 is filled with crusher fine 34 such as three-eighth inch minus (–⅜") crusher fine. Next, perpendicular drainpipes 36 are connected to main pipe 26. Perpendicular drainpipes 36 are preferably four inch (4") perforated sewer drainpipes laid in perpendicular trenches 38 on a zero to one inch (0"–1") slope or in heavy rain areas from zero to twelve inches (0"–12"). These are also encased in crusher fine 34. FIG. 4 shows the installed main pipe 26 along the length of field 40, sloped as shown with dimension F 42, normally about eighteen inches (18"), near the center of field 40 and dimension G 44, normally about nineteen inches (19"), near the ends of field 40. FIG. 5 shows the drainage installation along the width of field 40. Main pipe 26 is in shown as installed into the ground at dimension F 42. Perpendicular drainpipes 36 are connected to main pipe 26 as shown with outer ends sloped downward to dimension H 46. FIG. 6 shows a perspective view of the installed system with perpendicular drainpipes 36 installed every ten (10) yards. Main pipe 26 can drain into an existing drainage system such as a sewer drain via intermediate pipes 54.

Another unique feature of the present invention is the nailers and how the turf is affixed to the nailers. The preferred embodiment showing a nailer is in FIG. 7. As previously described, other systems of installation use wood and nails at the edges, which in turn weakens the stitching. The present system uses nailers 50, which is a material stronger than wood deriving from a recycled plastic composite, which is durable, and does not rot or warp like wood. Nailers can be made of reclaimed wood and plastic composite. The plastic shields the wood from moisture and insect damage, so there's no rotting or splintering. The wood protects the plastic from UV damage. Nailers 50 have a flexibility of three hundred sixty degrees (360°) and remain sturdy and strong after years of use. This technique provides the opportunity to install the artificial grass material or turf 10 on rounded or angled surfaces without weakening. To install nailers 50, they are placed on the outside perimeter using stakes or if concrete borders exist, they are secured with ramset nails or staples 52 to an existing concrete perimeter. All nailers 50 must be kept level with original grade surveyed using either laser level or transit. Turf 10 is then attached by staples or nails 52 to nailers 50 as shown. Turf 10 is pulled over nailers 50 which has been secured into the drainage base. Preferably turf 10 is pulled over nailers by one to four inches (1"–4") inches for attachment.

To complete an installation, please refer again to FIGS. 2 through 6. The next step is to install three-eighth inch minus (–⅜") crusher fine 34 inside the perimeter to a depth of six to twelve inches (6" to 12") over the perpendicular trenches 38, and the excavated dimension A 20. Using a laser motor grater, or the like, manipulate the three-eighth inch minus (–⅜") crusher fine 34 drainage basin to grade previously determined with transit or laser level. Moisture is then added to aid in compaction of material. Next, an asphalt roller with vibrator plate can be used to compact the drainage base. Finally, a laser level can be used to bring drainage basin back to grade.

Figure 7:
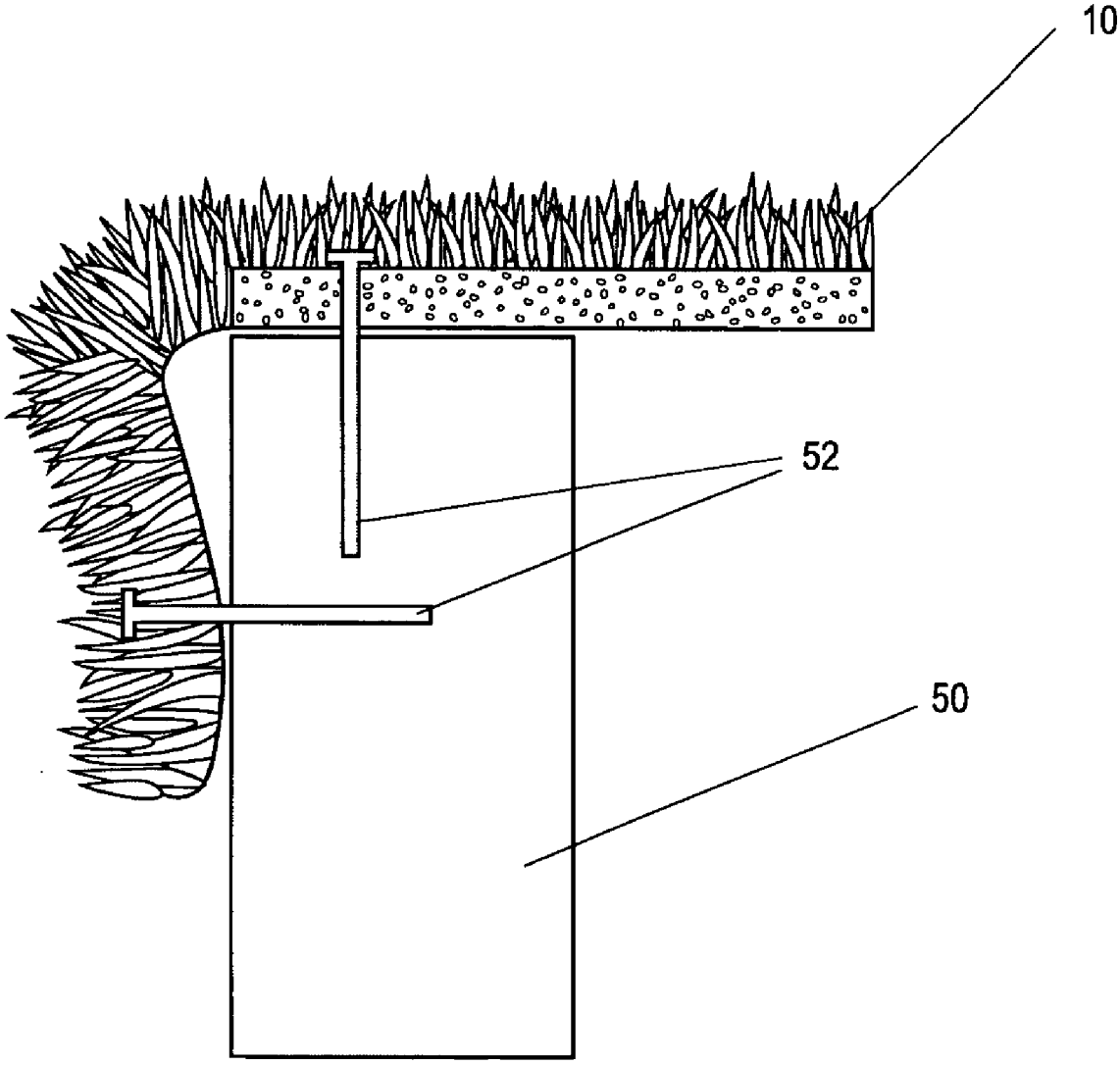
FIG. 7 shows the preferred turf affixed to the nailer.

The final step in the process is to install turf 10. Turf 10 is seemed together and laid on top of drainage base. Turf 10 is pulled over and stapled to the top and side of perimeter of nailers 50 with staples or nails 52, as shown in FIG. 7. Turf 10 is then filled with the appropriate mixed infill material 14 comprising rubber and silica sand.

The drainage system removes applied moisture as follows. Gravity pulls the water down through the turf 10 grass blades, and infill mixture of rubber and silica sand 14. The water drains through the apertures of holes in the backing of turf 16. The water is then absorbed and dispensed though three-eighth inch minus (–⅜41 ) crusher fine 34. Since three-eighth inch minus (–⅜") crusher fine 34 is a mixture of very fine particle aggregate and larger piece aggregate, some water is absorb by the fine particle aggregate, the rest of the water flows slowly between the larger pieces of aggregate. This mixture provides a system where water can quickly be absorbed, but also at the same time have the avenue of draining down. The very fine particle aggregate absorbs first, as it reaches its absorption capacity it then begins to dispense the water (through pressure with gravity) outward and down. As the water flows down it reaches perpendicular drainpipes 36, where the some of the water leaches out through the perforations and the rest flows with the sloping of perpendicular drainpipes 36 to main pipe 26. Main pipe 26 also has perforations which also leaches into large aggregate or gravel 32 preferably comprising three and one-forth inch (¾") crusher fine. The remaining water is then drained off the field or into an existing drainage system via intermediate pipes 54. With a plurality of perpendicular drain pipes 36 leading into main pipe 26, the crusher fine 34 and the addition of large aggregate or gravel 32, the system produces a time system delay to prevent main pipe 26 from overflowing. In the case of heavy precipitation the leech field provides an area where water can overflow until it can be drained.

The system as described above does not require each of the described elements for an installation. The system as described is for the best mode of installing a large turf system, such as a football field. Smaller installations can eliminate some of the elements, reduce the number of elements or the dimensions can be optimized for specific installations.

This system lowers injuries, becomes softer and stronger the more it is used, and drains large amounts of water. By using the above material as specified for the specific uses, a resulting safer G-Max rating, rated at ninety-six (96), is achieved. Crusher fine 34 not only adds to the absorption and the drainage, but it also has the ability to give which enables the turf to have the ability to be safer and drain faster.

The compaction rate is the safest G-max rating for soccer, football, rugby, and like games. The absorption drainage rate of water will cause less slippage and promotes water absorption at a speed of 16" of water per hour. The speed of drainage in effect causing less slippage for any person/player for recreational or sports use. The special infill mixture combined with the unique drainage components are effective when there is great amount of moisture and when the components are dry they do not compact causing a suitable and safe environment for sports, for example, activities such as running, walking and playing. The system is safe for sports with cleat usage because they do not drag or cut the speed variation as well.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A drainage system for a substantially flat artificial turf surface comprising:

artificial turf material comprising a ribbon height and further comprising a plurality of perforations on a backing material;

an infill mixture comprising a non-compacting sand material and a symmetric rubber granule material, said mixture comprising a predetermined mixture percentage and a predetermined fill height with respect to said ribbon height;

said artificial turf material disposed on a crusher fine material, said crusher fine material comprising a predetermined fill height forming said substantially flat surface;

a plurality of perpendicular perforated drainpipes encased in said crusher fine material; and a perforated main pipe laid substantially down a center of a trench beneath the substantially flat artificial turf surface for capturing liquid from said plurality of perpendicular perforated drainpipes.

2. The drainage system of claim 1 wherein said plurality of perforations in said backing material comprise apertures at a predetermined distance from a center of a stitching of said turf material.

3. The drainage system of claim 1 wherein said non-compacting sand comprises ninety-seven percent or better pure and dust free silica.

4. The drainage system of claim 1 wherein said infill mixture comprises a premixed infill mixture.

5. The drainage system of claim 1 wherein said crusher fine material comprises a three-eighths inch minus aggregate.

6. The drainage system of claim 1 wherein said perforated main pipe comprises a drain sock.

7. The drainage system of claim 1 further comprising a slope for said perforated drainpipes towards said main pipe.

8. The drainage system of claim 1 further comprising a sloped trench for disposing said main pipe, said main pipe encased in a large aggregate.

9. The drainage system of claim 1 further comprising a means for draining the liquid into an existing drainage system.

10. A method for draining liquid from a substantially flat artificial turf surface, the method comprising the steps of:

a) excavating a ground surface to a predetermined dimension;

b) laying a perforated main pipe down a center in the excavated ground surface;

c) laying a plurality of perforated drainpipes and connecting the perforated drain pipes to the perforated main pipe;

d) filling the excavated ground surface with an aggregate material forming the substantially flat surface;

e) installing the artificial turf surface over the aggregate material; and f) filling the artificial turf surface with a premixed infill material.

11. The method of claim 10 wherein the step of excavating comprises excavating a trench for the main pipe.

12. The method of claim 10 wherein the step of excavating comprises providing a slope towards the main pipe.

13. The method of claim 10 wherein the step of excavating comprises excavating a trench for the main pipe.

14. The method of claim 10 wherein the aggregate material comprises a crusher fine material.

15. The method of claim 10 wherein the perforated main pipe comprises a drain sock.

16. The method of claim 15 further comprising the step of laying the main pipe with the perforations facing the artificial turf surface.

17. The method of claim 10 further comprising the step of connecting the main pipe to an existing drainage system.

18. The method of claim 10 wherein the premixed infill material comprises a non-compacting sand material and a symmetric rubber granule material.

19. The method of claim 10 wherein the step of filling the artificial turf surface comprises filling with the infill material to a height comprising a predetermined percentage of a ribbon height.

* * * * *